United States Patent [19]

Tackett et al.

[11] Patent Number: 4,752,259

[45] Date of Patent: Jun. 21, 1988

[54] SWIM FINS

[76] Inventors: Edd Tackett, 1817 Mirracerros La., Alamogordo, N. Mex. 88310; Hubert Tackett, 6920 Wilson Dr., Apt. #2, Knoxville, Tenn. 37924

[21] Appl. No.: 4,327

[22] Filed: Jan. 16, 1987

[51] Int. Cl.[4] ..... A63B 31/11

[52] U.S. Cl. ..... 441/64

[58] Field of Search ..... 441/60, 61, 62, 63, 441/64; D21/239

[56] References Cited

U.S. PATENT DOCUMENTS

| | | | |
|---|---|---|---|
| 1,729,477 | 9/1929 | Douglas | D21/239 X |
| 1,788,013 | 1/1931 | Christianson | 441/64 |
| 3,068,499 | 12/1962 | Biskupsky | 441/63 |
| 3,081,467 | 3/1963 | Ciccotelli | 441/63 |
| 3,268,927 | 8/1966 | Markowitz | 441/63 |
| 3,315,286 | 4/1967 | Brion | 441/64 |
| 4,264,994 | 5/1981 | Carbone | 441/64 X |

FOREIGN PATENT DOCUMENTS

| | | | |
|---|---|---|---|
| 2565498 | 12/1985 | France | 441/64 |
| 533240 | 3/1958 | Italy | 441/62 |
| 688622 | 4/1965 | Italy | 441/64 |
| 1189460 | 11/1985 | U.S.S.R. | 441/64 |

*Primary Examiner*—Galen Barefoot
*Assistant Examiner*—Paul E. Salmon
*Attorney, Agent, or Firm*—N. J. Aquilino

[57] ABSTRACT

A swim fin adapted to be used in the swimming or walking mode having a foot engaging portion adapted to be worn by a user and a two-part fin formed of an inner portion and outer portion which are connected to each other and rotatable with respect to each other using a suitable hinge assembly so that the outer portion may be folded on top of or under the foot wearing portion to facilitate walking and to enable the outer portion to be extended to facilitate swimming. Suitable locks are provided to maintain the fin portions in the extended or folded positions.

2 Claims, 4 Drawing Sheets

SWIM FINS

BACKGROUND AND SUMMARY OF THE INVENTION

The present invention relates to swim fins, and more particularly to swim fins which may be used for either swimming or walking.

The configuration of most commercially available swim fins is ideal for swimming, but very impractical on the water's bottom or out of the water on a walking surface. Normally, the swim fins must be removed while on such surfaces and not put on until deep water is reached. It is particularly difficult to walk in shallow water because of the resistance to movement as the fin is moved through the water.

Various attempts have been made in the past to detach the fin portion, reverse it or collapse it to facilitate walking. The known prior art has created complex structures which are awkward in design and which do not provide maximum assistance in the swimming mode. Examples of this prior art are shown in the patents to Brion U.S. Pat. No. 3,315,286 and to Markowitz U.S. Pat. No. 3,268,927.

The present invention is directed to an improved swim fin construction which is efficient and practical in the water and which allows the diver-swimmer to convert from the swim mode to a walking mode so the user can walk on any type surface including the water's bottom, on diving platforms, on ladders, in boats, and anywhere around a swimming environment.

The swim fin of the present invention provides a rubber shoe having a foot opening and a fin integrally attached thereto. The fin is made in two sections and are connected together by a rotating hinge. The outer portion of the fin may be folded upwardly on top of the shoe portion in the walking position or folded under the shoe portion. Suitable latching mechanisms are provided to keep the fin extended when used in the swimming position and retracted in the walking position.

Among the objects of the present invention is the provision of an improved swimming fin which is useable for swimming and walking.

Another object of the present invention is the provision of a swimming fin which is simple in design and is easily adjustable for movement between the swimming and walking positions.

DESCRIPTION OF THE PREFERRED EMBODIMENT

Figure 1:
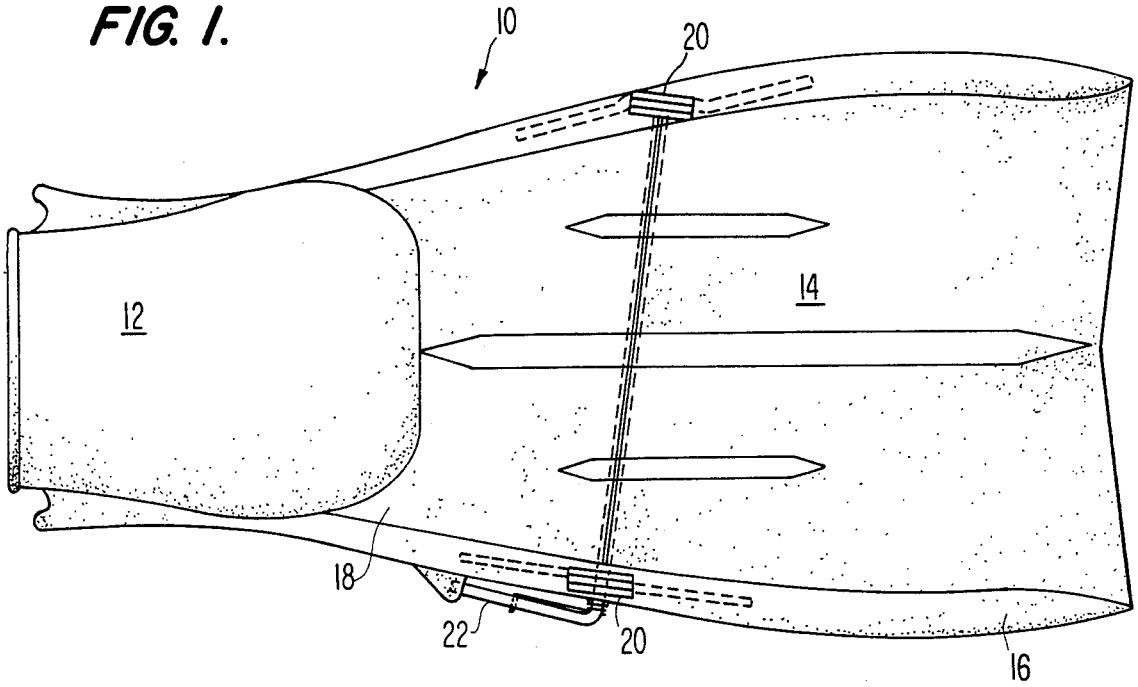
FIG. 1 is a top plan view of one embodiment of the swim fin of the present invention.
Figure 2:
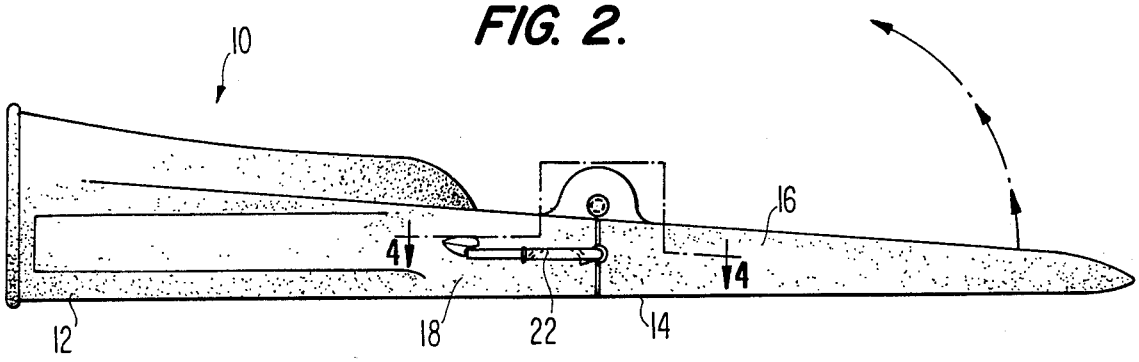
FIG. 2 is a side elevational view of FIG. 1 with the fin in the extended swimming position.
Figure 3:
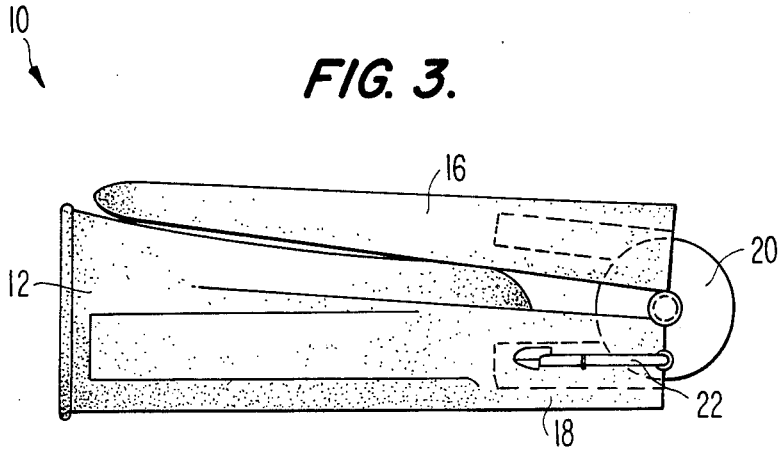
FIG. 3 is a side elevational view of FIG. 1 with the fin in the folded walking position.
Figure 4:
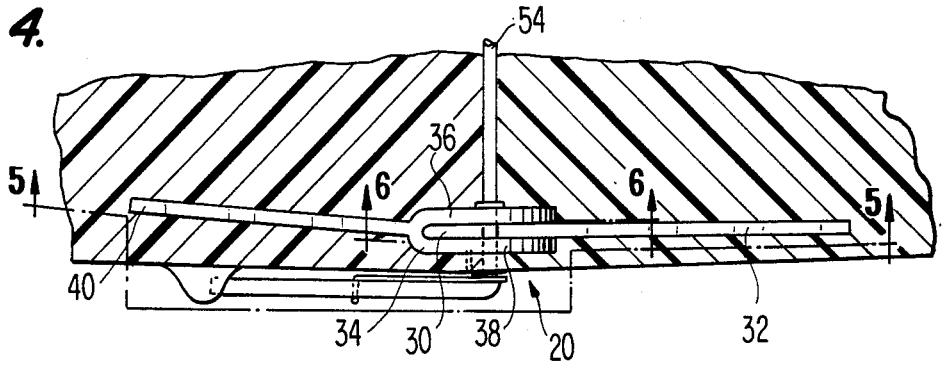
FIG. 4 is a partial sectional view of a detail of the swim fin taken along the line 4—4 of FIG. 2.
Figure 5:
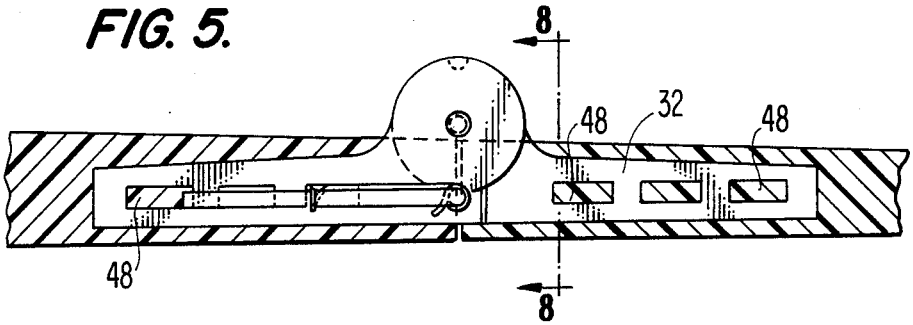
FIG. 5 is a partial sectional view of a detail of the swim fin taken along the line 5—5 of FIG. 4.

FIGS. 1 through 3 illustrate a first embodiment of the folding swim fins of the present invention. As seen in the drawings, the swim fin 10 is formed of a conventional rubber shoe section 12 having an opening, not shown, into which a user's foot is inserted. The fin may or may not be provided with a suitable strapping means to secure the fin onto the foot of the user. The fin portion 14 is formed of an outer section 16 and an inner section 18. As shown in FIG. 2 with the fin portion extended, the outer section 16 and inner section 18 are complimentary to each other to provide a smooth fluid bearing surface to propel the user through the water. As shown in FIG. 3, when the fin is used for walking on the bottom surface or for walking out of the water, the outer portion 16 may be folded on top of the foot opening section 12 so that it does not get in the way when the user walks.

The outer section and inner section of the fin are connected by means of rotating hinges 20 which permit relative movement between the two parts. A pivotably catch 22 is provided to lock the hinges 20 to keep the outer and inner portions either in the extended or folded positions relative to each other as described hereinbelow. As seen in the plan view of FIG. 1, the separation between the inner and outer portions of the fin 10 is positioned at an angle between 5 and 7 degrees with respect to the longitudinal axis of the swim fin 10 in order to facilitate the folding of the outer portion 16 of the fin portion 14 on top of the rubber shoe section 12. This eliminates lateral overlap of the inner and outer portions and facilitates walking. Hinges 20 are provided; one on each of opposite sides of the swim fin 10. The hinges 20 are embedded in the thickened structure toward the edge of the fin portion 14.

Referring to FIGS. 4 through 8, the hinge assembly is shown in detail. Each hinge 20 is formed of two members which rotate relative to each other. A central, disk shaped member 30, having an integrally formed leave 32, rotatably fits within a second member 34 having bifurcated disk elements 36 and 38 and an integrally attached leave 40. A hinge pin 42, having a head 44 and secured by a retainer clip 46, fits in suitable openings in the hinge members 30 and 34.

The leaves 32 and 40 of the respective members 30 and 34 are longitudinal in shape and are provided with a series of openings 48. The leaves 32 and 40 are embedded in the fin structure and retained therein by the moldable material of the fin which flows through the openings 48 to provide an efficient connection with the fin.

The central member 30 includes notches 50 and 52 which are spaced approximately 180 degrees apart and are adapted to receive the longitudinal shaft 54 of the pivotable catch 22 when one of the notches 50 or 52 is aligned with the shaft. The shaft 54 includes a cut-out 56 which in the unlatched position provides a clearance between the shaft 54 and the central member 30 permitting the disk shaped member 30 to be rotated with respect to the bifurcated hinge member 34 without interfering with the catch 22.

Figure 6:
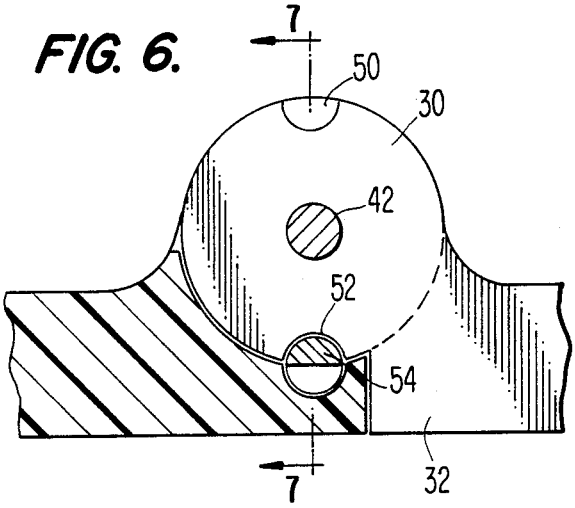
FIG. 6 is a partial sectional view of a detail of the swim fin taken along line 6—6 of FIG. 4.
Figure 7:
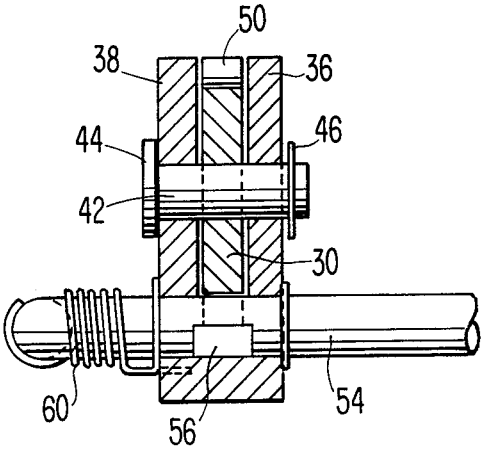
FIG. 7 is a partial sectional view of a detail of the swim fin taken along line 7—7 of FIG. 6.
Figure 8:
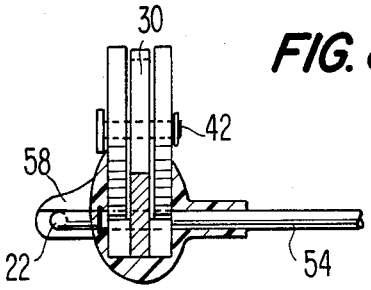
FIG. 8 is a partial sectional view of a detail of the swim fin taken along line 8—8 of FIG. 5.
Figure 9:
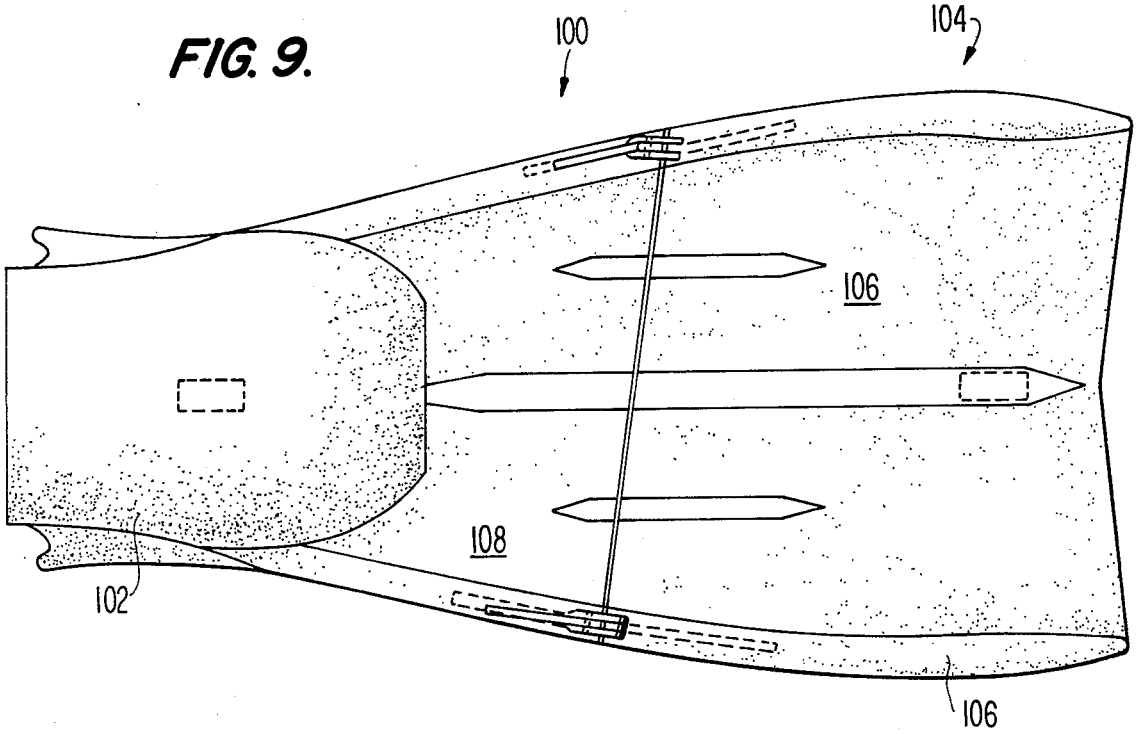
FIG. 9 is a top plan view of a second embodiment of the swim fin of the present invention.
Figure 10:
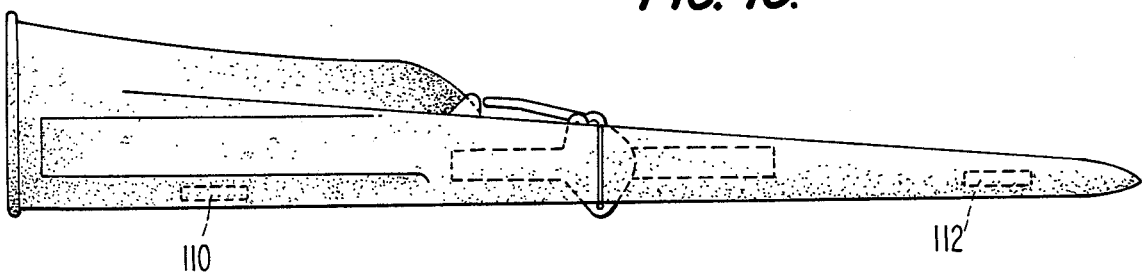
FIG. 10 is a side elevational view of FIG. 9 with the fin in the extended swimming position.

When the outer fin portion 16 is positioned in either the folded or extended position, the pivotable catch 22 is rotated to the locking position and the shaft 54 will be engaged in either notch 50 or 52 to prevent movement of the hinge 20 during use as shown in FIGS. 6 and 7. A retainer lug 58 keeps the pivotable catch 22 in place during use using a spring 60 which urges the pivotable catch 22 against the lug 58 to prevent movement and to keep the catch 22 secured.

Figure 11:
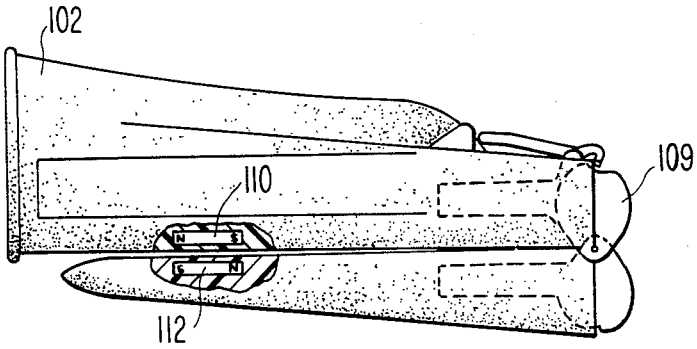
FIG. 11 is a side elevational view of FIG. 9 with the fin in the folded walking position.
Figure 12:
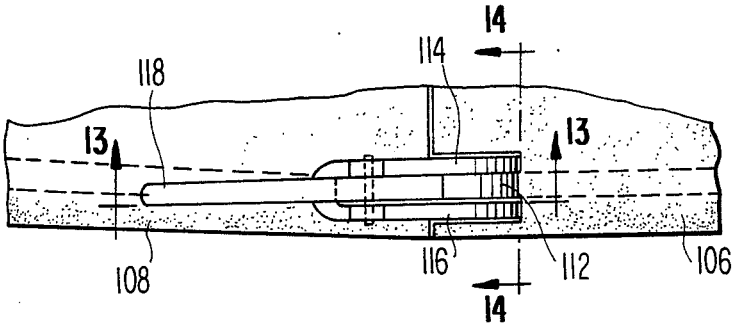
FIG. 12 is a view of a detail of the swim fin of FIG. 9.
Figure 13:
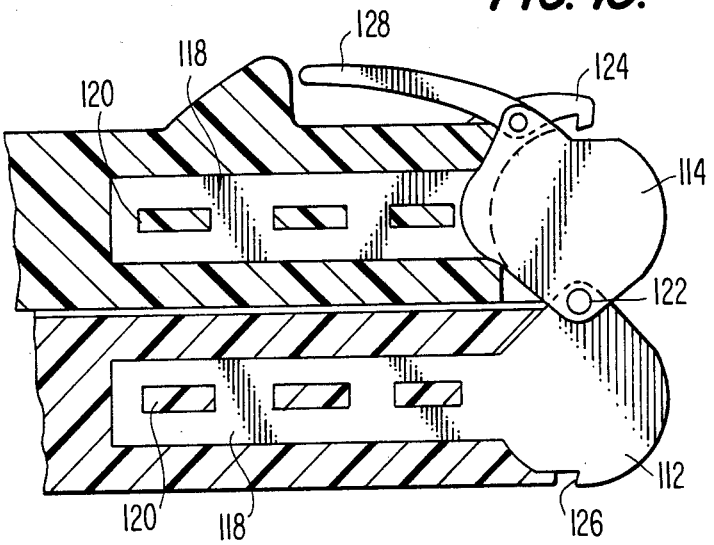
FIG. 13 is a partial sectional view of a detail of the swim fin of FIG. 11.
Figure 14:
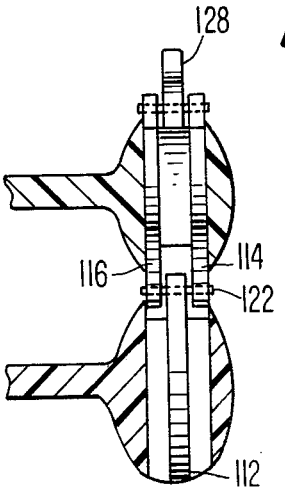
FIG. 14 is a partial sectional view of a detail of the swim fin taken along the line 14—14 of FIG. 13.

FIGS. 9 through 14 illustrates the second embodiment of the swim fin of the present invention wherein the fin is adapted to be folded under rather than over the top when in the folded position. The swim fin 100 includes a foot engaging shoe 102 having an opening, now shown, and a fin 104 formed of an outer member 106 and an inner member 108. A hinge 109 as shown in greater details in FIGS. 12, 13 and 14, permits rotational movement of the outer portion 106 of the fin 104 enabling it to be rotated under the foot engaging shoe 102 and the inner portion of the fin 108 as illustrated in FIG. 11. A preferred latching arrangement would include a pair of magnets 110 and 112 embedded in the outer section 106 and inner section 108, respectively. When the outer section 106 is folded under the inner section 108, the strength of the two magnets attracting each other is sufficient to hold the arrangement in place. In this embodiment, the hinge 109 is formed similar to that with respect to the first embodiment, and uses a central disk 112 which rotates between outer disks 114 and 116 as shown in the drawings. Suitable splines 118 also having openings 120 are embedded in the thickened parts of the outer and inner sections of the fin 100. A pin 122 connects the disk 112 to the disks 114 and 116. A suitable latch 124 engages a notch 126 in the central disk 112 to keep the hinge locked together in the extended position. A lever 128 is used to disengage the latch 124 enabling the outer portion of the fin to be folded under against the inner portion 108.

In both embodiments, the operation of the swim fin becomes obvious with respect to the structure. When it is desired to use the fins for walking, the respective locking levers are released and the outer portion of the fins are either folded on top or under the inner portion of the swim fin. When it is desired to use the fins in a deep water swimming condition, the outer portion of the fins are released and extended permitting the locking latches to engage to maintain the fin in this position.

It will be appreciated that other embodiments of the present invention may be used in keeping within the scope and spirit of the present invention as defined by the following claims.

I claim:

1. A swimming fin having a two-piece construction and being adapted to being positioned in a first extended position when used for swimming and to be positioned in a second folded position when used for walking on a solid surface comprising:

foot engaging means adapted to fit and cover a human foot;

fin means, formed of an inner portion adjacent said foot engaging means and an outer portion;

hinge connector means connecting said inner and outer portions and permitting rotational movement between said inner and outer portions;

said hinge connector means having first and second hinge elements connected between said inner portion and said outer portion of said fin means;

said swimming fins being further characterized by a two-position latching means for latching said hinge connector means and preventing movement thereof;

said two-position latching means including a first latch operative when said inner and said outer portions of said fin means are in said first extended position and a second latch operative when said inner and outer portions of said fin means are in said second folded position; and said swimming fin being further characterized by said first latch formed of a first notch on said hinge and a rotatable catch structured to engage said first notch when rotated in a first position and said second latch formed of a second notch on said hinge and said rotatable catch is structured to engage said second notch when rotated in a second position.

2. A swimming fin having a two-piece construction and being adapted to being positioned in a first extended position when used for swimming and to be positioned in a second folded position when used for walking on a solid surface comprising:

foot engaging means adapted to fit and cover a human foot;

fin means, formed of an inner portion adjacent said foot engaging means and an outer portion;

hinge connector means connecting said inner and outer portions and permitting rotational movement between said inner and outer portions;

said hinge connector means having first and second hinge elements connected between said inner portion and said outer potion of said fin means;

said swimming fin being further characterized by a two-position latching means for latching said hinge connector means and preventing movement thereof;

said two-position latching means including a first latch operative when said inner and said outer portions of said fin means are in said first extended position and a second latch operative when said inner and outer portions of said fin means are in said second folded position; and said swimming fin being further characterized by said first latch formed of a notch on said hinge and a catch engageable therewith and said second latch formed of a pair of mutually attracting magnets, one of said pair of magnets being imbedded in said inner portion of said fin means and a second of said pair of magnets being imbedded in said outer portion of said fin means.

* * * * *